US007357341B2

(12) United States Patent
Gutwein et al.

(10) Patent No.: US 7,357,341 B2
(45) Date of Patent: Apr. 15, 2008

(54) TWO STAGE SEWAGE GRINDER PUMP

(75) Inventors: Gregory J. Gutwein, Dayton, OH (US); Donald Holder, Troy, OH (US); Mark P. Kowalak, Troy, OH (US); Bruce B. Ordway, Troy, OH (US)

(73) Assignee: Crane Pumps & Systems, Inc., Piqua, OH (US)

( * ) Notice: Subject to any disclaimer, the term of this patent is extended or adjusted under 35 U.S.C. 154(b) by 0 days.

(21) Appl. No.: 10/595,301

(22) PCT Filed: Oct. 14, 2004

(86) PCT No.: PCT/IB2004/052100

§ 371 (c)(1),
(2), (4) Date: Apr. 6, 2006

(87) PCT Pub. No.: WO2005/035447

PCT Pub. Date: Apr. 21, 2005

(65) Prior Publication Data

US 2007/0069050 A1 Mar. 29, 2007

Related U.S. Application Data

(60) Provisional application No. 60/511,288, filed on Oct. 14, 2003.

(51) Int. Cl.
*B02C 18/40* (2006.01)
*B02C 23/36* (2006.01)

(52) U.S. Cl. ..... 241/46.11

(58) Field of Classification Search .....
241/46.017–46.17, 21
See application file for complete search history.

(56) References Cited

U.S. PATENT DOCUMENTS 3,650,481 A 3/1972 Conery et al.
6,010,086 A 1/2000 Earle et al.
6,916,152 B2 7/2005 Keener

*Primary Examiner*—Mark Rosenbaum
(74) *Attorney, Agent, or Firm*—Standley Law Group LLP

(57) ABSTRACT

A two-stage sewage grinder pump (10) having two impellers (30, 32) and a grinder (60) attached to the motor shaft (24). Preferably, both impellers are vortex impellers and are positioned between the grinder and the motor. The motor housing includes a discharge conduit (70) that is monolithic with the motor housing (20). An anti-siphon valve (71) is integral with the discharge conduit. An integral discharge flange (75) and check valve (78) are attached to the discharge conduit to connect the sewage grinder pump to a sewage outlet.

11 Claims, 11 Drawing Sheets

TWO STAGE SEWAGE GRINDER PUMP

This application is a national stage entry of PCT/lB2004/052100, filed Oct. 14, 2004, which designates the United States of America and which claims priority from provisional application 60/511,288, filed Oct. 14, 2003, the disclosure of which is hereby incorporated by reference.

BACKGROUND OF THE INVENTION

This invention relates generally to sewage grinder pumps and more particularly to two-stage high head low flow sewage grinder pumps.

Many residential sewer systems use only the force of gravity to provide for discharging its wastewater into progressively larger sewer mains and ultimately to a dedicated treatment plant that is usually located in a low-lying area such that gravity can assist the flow of sewage. However, in a hilly land area, in a below-grade setting, along long horizontal pipe runs or perhaps due to smaller-diameter piping restrictions, gravity often will not suffice. In such situations, a lift-station or a stand-alone sewage ejector pump is required if gravity alone will not allow flow of sewage at a speed of at least 2 feet per second, which is considered to be a minimum required velocity to maintain suspended sewage solids in suspension. One type of ejector pump is a submersible grinder pump. In areas of flow pressure, one can employ such a fixture to move the sewage from a given location to a sewage collection system. The pump may be installed below the nearest available sewer line. The pump will either lift the waste to the level of the main drain or move the sewage through the piping.

Grinder pumps cut and grind solid materials into tiny pieces and are designed to reduce sewage particulate to a slurry. This overcomes sewage passageways restrictions and allows free movement of the fluid. A commonly used submersible grinder pump is a centrifugal pump with a recessed vortex impeller. In these systems, one can expect a power range of 2 to 7.5 horsepower (HP). Residences generally use the 2 HP models, principally due to its compatibility with typical residential electric-circuit configurations that provide comparatively low power. However, one may require a larger HP centrifugal pump, an intermediate lift station, or a progressing cavity style pump when sewer system pressures or flow resistance exceeds the capabilities of a 2 HP centrifugal pump. In residential applications, such systems are often unaffordable.

The progressing cavity pump's major advantage is its ability to work under relatively high pressures and allow service to areas with high-pressure requirements without the need for additional lift stations or relatively high HP pumps. Unfortunately, wear items that readily fail at high pressures, such as that pump's wobble stator arrangement, are a significant disadvantage.

Alternatively, centrifugal pumps offer higher flow rates than progressing cavity style pumps, have the ability to handle abrasives and slurries, and can operate at stall head or zero flow for extended periods without causing pump damage. For example, design pressures can be readily exceeded and can remain high until an upset condition, such as excessive simultaneous operations following a power outage, or high infiltration caused by poor installation, is resolved. However, a 2 HP residential centrifugal pump will have a significantly lower pressure limitation than a progressing cavity pump and is not suited for pressure sewer systems that achieve a total system head (distance pump is capable of lifting fluid) greater than 120 feet at the pump.

Thus, in a pressure sewer system where upset conditions produce high system pressures, both the progressing cavity and typical single-stage centrifugal grinder pumps lack relevant design efficiencies and possess limiting capabilities. However, since the centrifugal pump with recessed vortex impeller is more robust and reliable, a welcome pump design modification will combine this advantage with the high-pressure advantage of the progressing cavity pump to produce a pump that is affordable and still suitable to residential applications.

The foregoing illustrates limitations known to exist in present sewage grinder pumps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a sewage grinder pump comprising: a housing; a motor enclosed within the housing, the motor having a shaft extending therefrom; a plurality of impellers attached to the motor shaft; and a grinder attached to the motor shaft, the grinder and the plurality of impellers having a common axis of rotation.

In another aspect of the present invention, this is accomplished by providing a sewage grinder pump comprising: a housing; a motor enclosed within the housing, the motor having a shaft extending therefrom; a pump attached to the motor shaft; and a grinder attached to the motor shaft, the housing having a discharge conduit monolithic therewith, the discharge conduit being in fluid communication with the pump.

In another aspect of the present invention, this is accomplished by providing a method for grinding and pumping sewage comprising: providing a motor having a shaft extending therefrom with a first stage impeller, a second stage impeller and a grinder attached thereto; operating the motor to rotate the attached impellers and grinder; introducing sewage into the grinder; grinding any solids contained in the sewage in the grinder; passing sewage from the grinder into the first stage impeller; increasing the pressure of the sewage by rotation of the first stage impeller; passing sewage from the first stage impeller into the second stage impeller; increasing the pressure of the sewage further by rotation of the second stage impeller; and discharging the pressurized sewage into a sewer system.

In another aspect of the present invention, this is accomplished by providing a sewage grinder pump comprising: a housing; a motor enclosed within the housing, the motor having a shaft extending therefrom, the motor being about 2 horsepower; two impellers attached to the motor shaft, a first stage impeller and a second stage impeller, the sewage grinder pump having a stall head greater than about 200 feet and a maximum flow greater than about 30 gallons per minute; and a grinder attached to the motor shaft.

In another aspect of the present invention, this is accomplished by providing a sewage grinder pump comprising: a housing; a motor enclosed within the housing, the motor having a shaft extending therefrom; a pump attached to the motor shaft; a grinder attached to the motor shaft; and a discharge flange in fluid communication with the pump, the discharge flange having a check valve integral therewith.

In another aspect of the present invention, this is accomplished by providing a sewage grinder pump comprising: a housing; a motor enclosed within the housing, the motor having a shaft extending therefrom; a pump operably attached to the motor shaft; a grinder operably attached to the motor shaft; and a discharge conduit in fluid communication with the pump, the discharge conduit having an anti-siphon valve integral therewith, the antisiphon valve having a valve seat and a movable valve.

In another aspect of the present invention, this is accomplished by providing a method of installing a sewage grinder pump in a basin, the basin having a sewage outlet connection, the method comprising: providing a sewage grinder pump; selecting an appropriate discharge flange from a plurality of discharge flanges comprising at least one discharge flange having a first configuration and at least one discharge flange having a second configuration; attaching the discharge flange to the sewage grinder pump; positioning the sewage grinder pump with the attached discharge flange within the basin; attaching the discharge flange to a sewage outlet connection.

In another aspect of the present invention, this is accomplished by providing a sewage grinder pump comprising: a housing; a motor enclosed within the housing, the motor having a shaft extending therefrom; a pump operably attached to the motor shaft; a grinder operably attached to the motor shaft; and a discharge flange attached to the housing, the discharge flange being in fluid communication with the pump, the discharge flange having a connector assembly, the connector assembly adapted to connect the discharge flange to a sewage outlet, the connector assembly including an elastomeric seal for sealingly engaging the sewage outlet.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
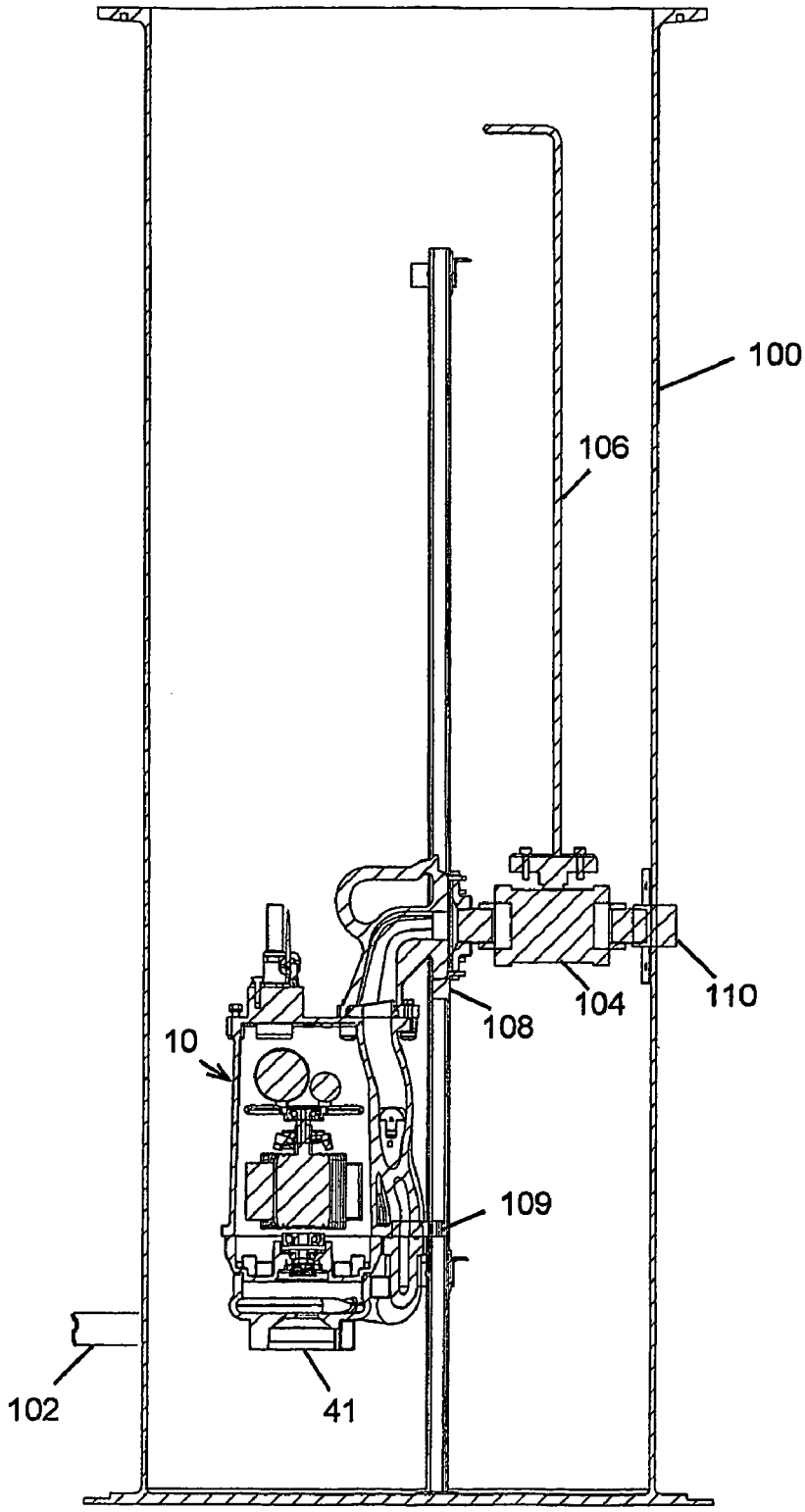
FIG. 1 is a cross-sectional view of a two-stage sewage grinder pump according to the present invention installed in a basin.
Figure 2:
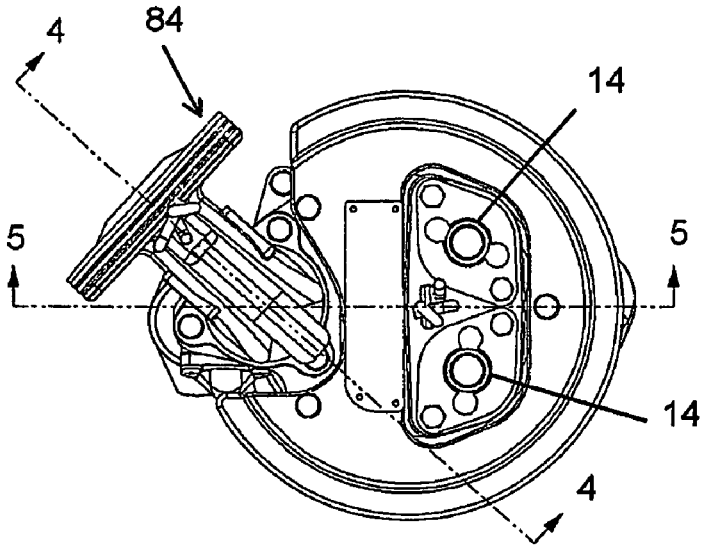
FIG. 2 is a top view of the sewage grinder pump shown in FIG. 1.
Figure 3:
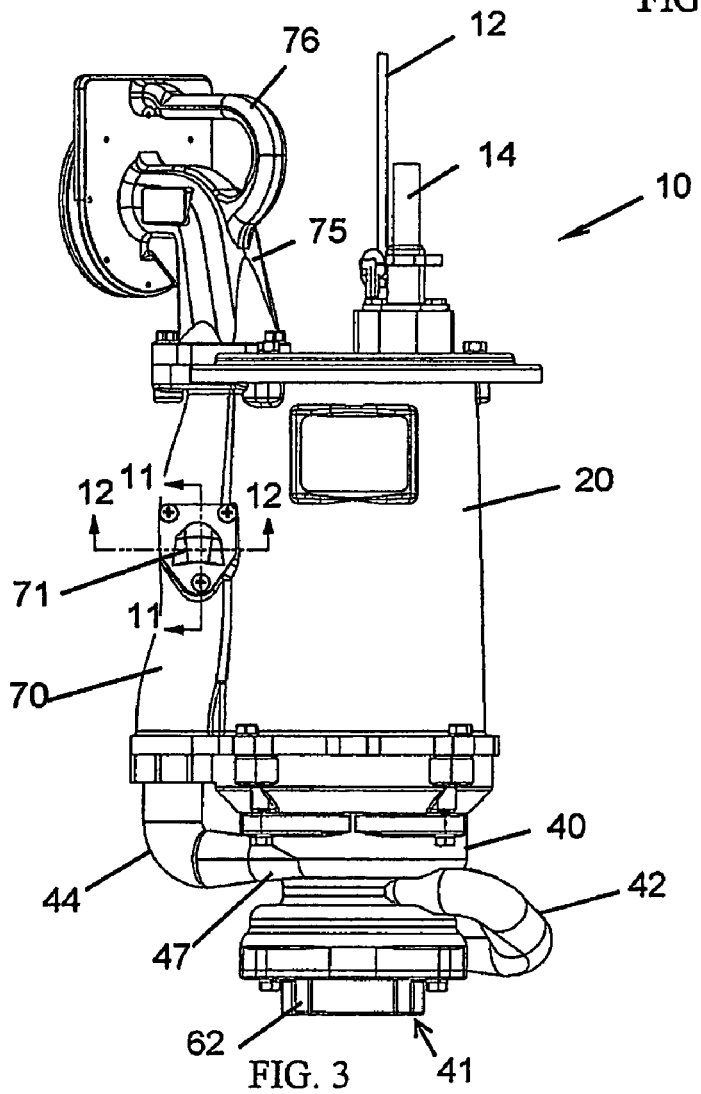
FIG. 3 is a front view of the sewage grinder pump shown in FIG. 1.
Figure 4:
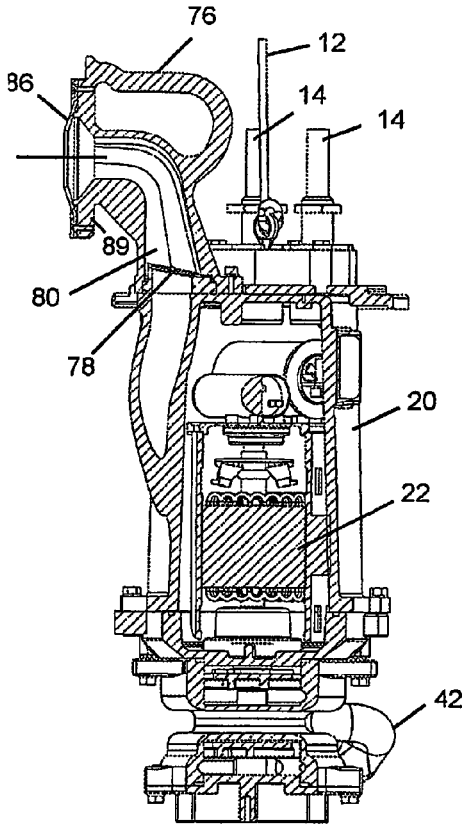
FIG. 4 is a cross-sectional view of the sewage grinder pump shown in FIG. 2 taken along line 4-4.
Figure 5:
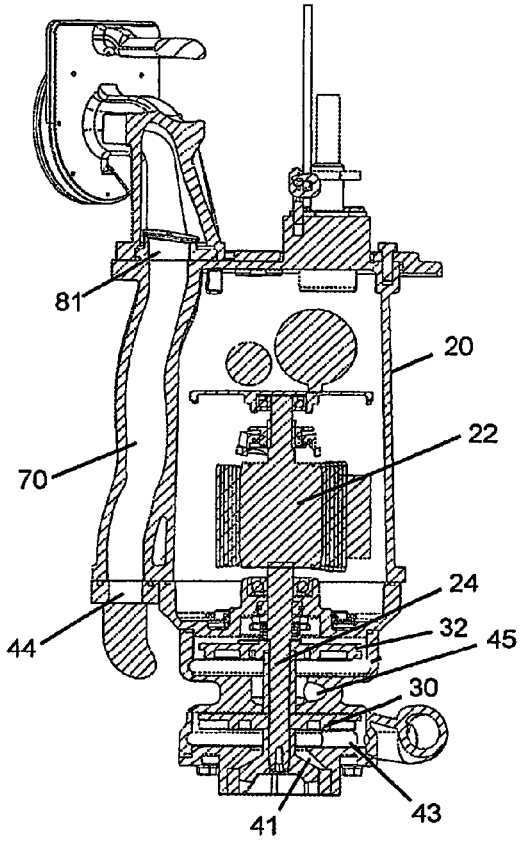
FIG. 5 is a cross-sectional view of the sewage grinder pump shown in FIG. 2 taken along line 5-5.

FIG. 1 shows a basin 100 with a sewage grinder pump 10 according to the present invention installed within the basin The basin 100 has a sewage inlet 102 that receives sewage from a home, business or other source. Sewage flows into basin 100 through the sewage inlet 102 and drops to the bottom of the basin. Sewage grinder pump 10 sits within the basin 100 on pump supports 108, 109, attached to support wall 114, that raise the pump inlet 41 above the bottom of the basin. The pump discharge fluid conduit 80 is connected to sewage outlet 110. An isolation valve 104 with an extended operator handle 106 is provided to isolate sewage grinder pump 10 from the sewage outlet 110 to allow maintenance or removal of the sewage grinder pump.

Sewage grinder pump 10 is further supported within basin 100 by a suspension cable 12. A pair of electrical conduits 14 provide electrical power and control signals to sewage grinder pump 10.

Figure 19:
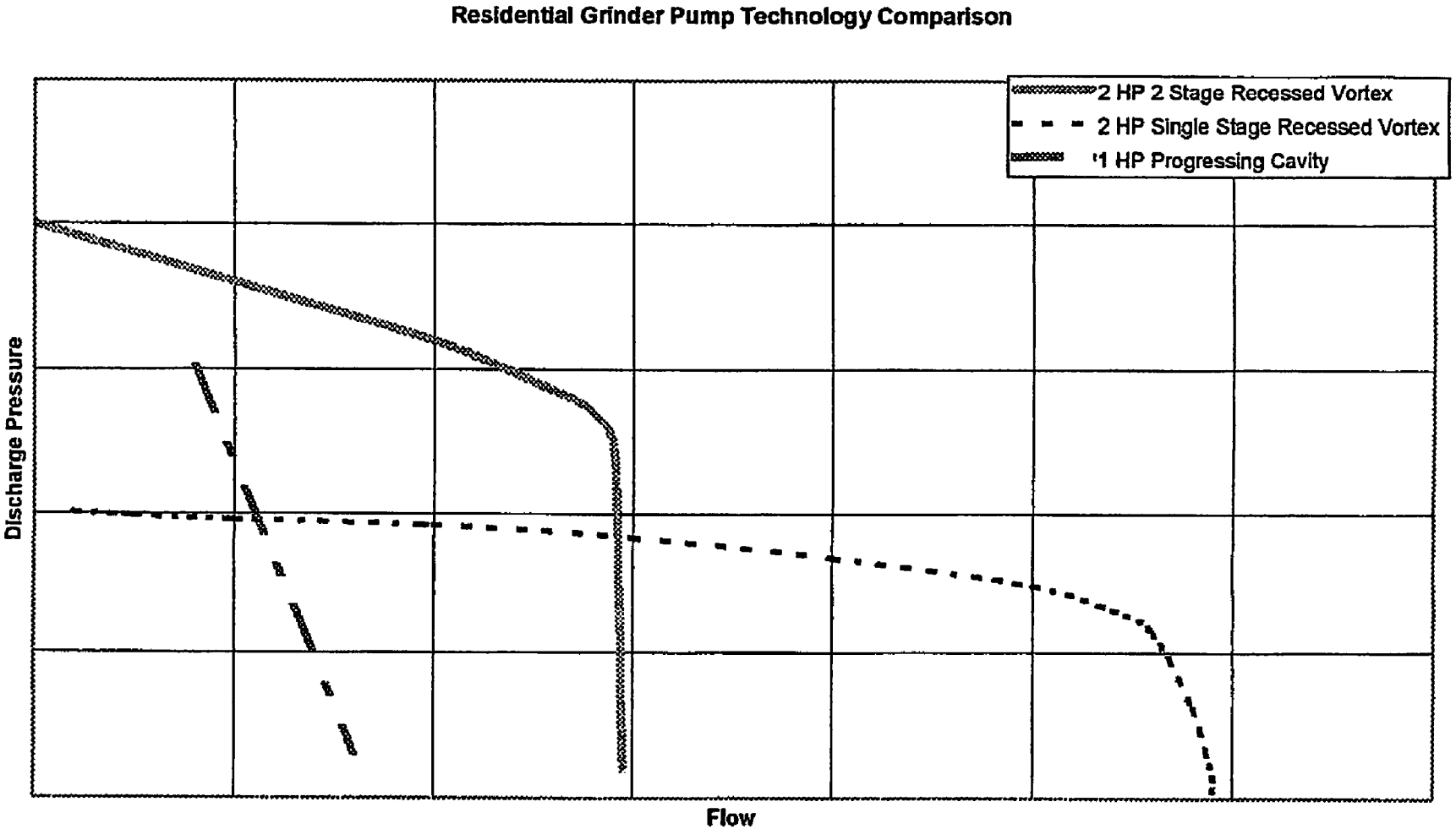
FIG. 19 is a general plot showing the relationship between pressure head versus flow rate for the sewage grinder pump shown in FIG. 1.

In operation, as the sewage level in basin 100 rises to a predetermined level, the pump control system turns the pump on. Sewage and any entrained solids enter the pump inlet 41 where the solids are reduced in size in grinder 60. The pressure of the sewage and the contained comminuted solids is then raised by the two stages of vortex impellers 30, 32. Preferably, the pump motor 22 is a 2 HP motor and the sewage grinder pump 10 has a shut-off head greater than about 200 feet and a maximum flow greater than about 30 gallons per minute, as shown in FIG. 19.

Figure 14:
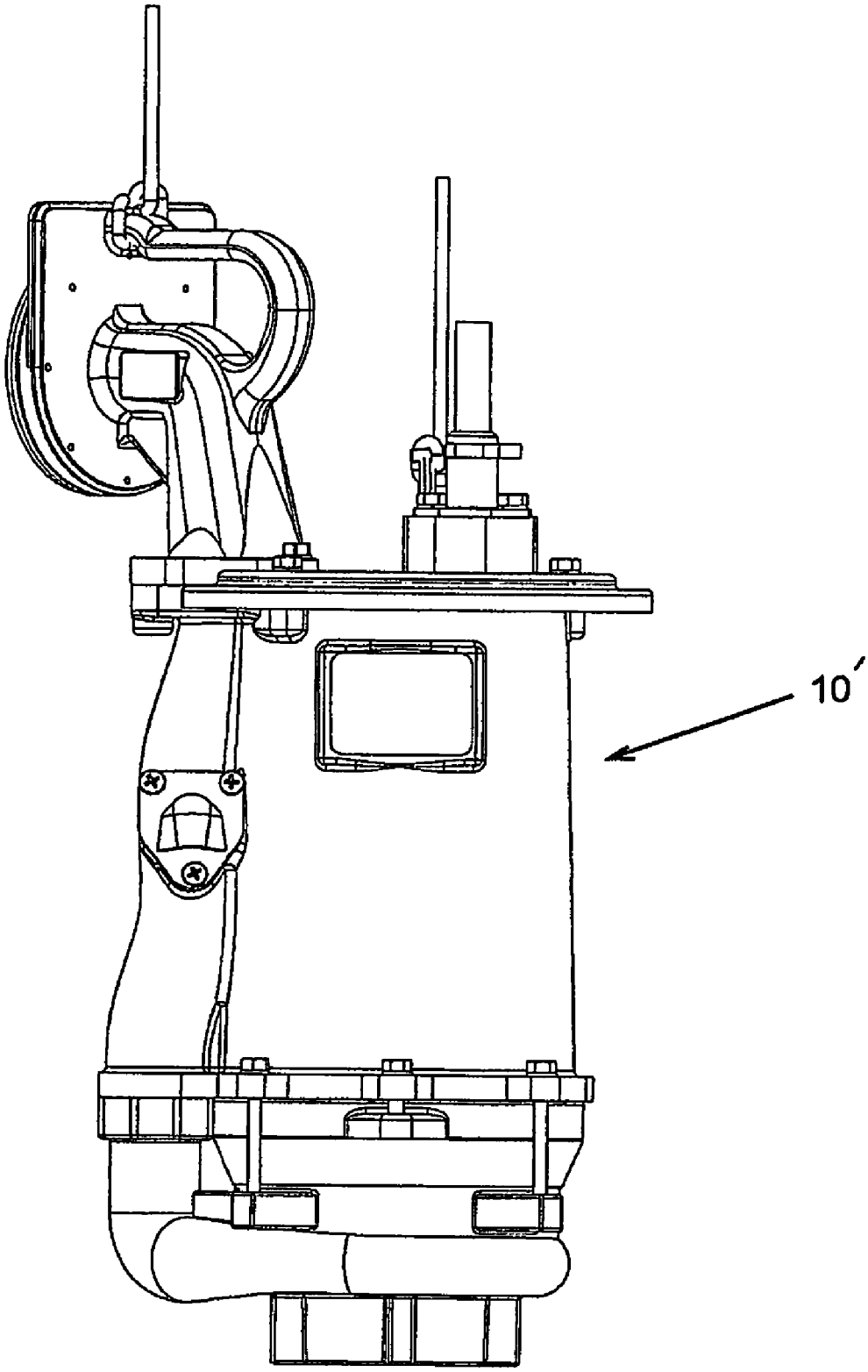
FIG. 14 is a front view of a single stage sewage grinder pump.

In one embodiment, sewage grinder pump 10 is provided with a plurality of pumping stages, see FIGS. 1 through 8. In an alternate embodiment, sewage grinder pump 10' is provided as a single stage pump, see FIG. 14.

Figure 15:
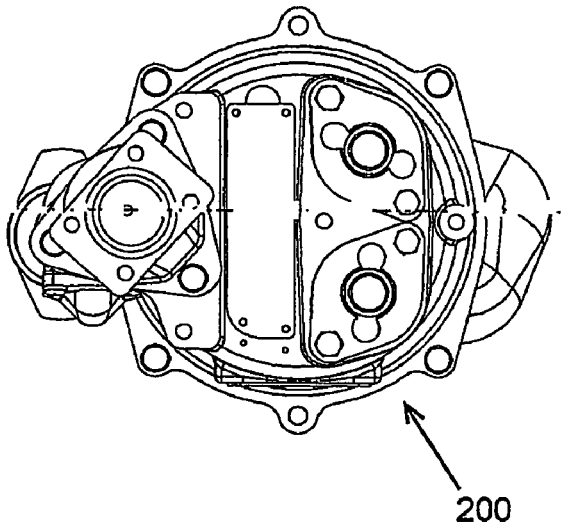
FIG. 15 is a top view of an additional embodiment of the two-stage sewage grinder pump according to the present invention.

Referring to FIGS. 2 through 8, the major components of sewage grinder pump 10 are shown. The major components of pump 10 are the pump housing 40, the motor housing 20 and discharge conduit 70 monolithic therewith, and discharge flange 75. Discharge flange 75 is provided in multiple configurations, see FIGS. 15 and 16. The pump housing 40 houses the grinder 60 and two stages of vortex impellers 30, 32.

Figure 7:
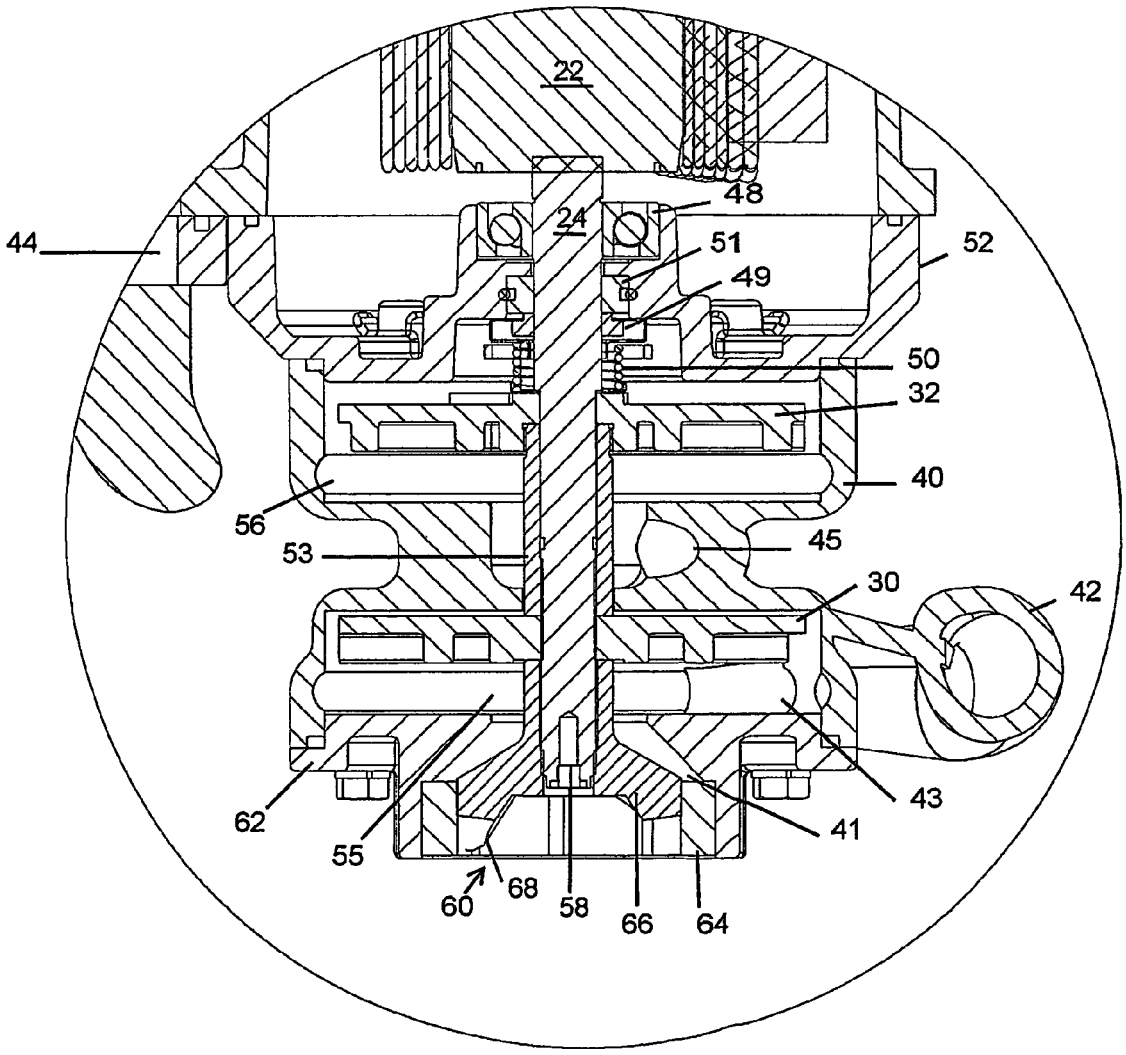
FIG. 7 is an enlarged cross-sectional view of the lower portion of the sewage grinder pump shown in FIG. 5.
Figure 8:
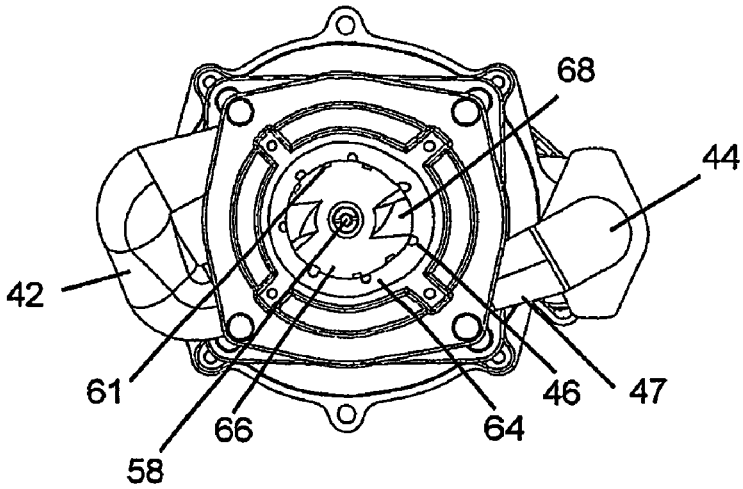
FIG. 8 is a bottom view of the sewage grinder pump shown in FIG. 1.

Starting with the pump housing 40, shown in an enlarged cross-section in FIG. 7, the pump housing has an inlet section 41, an inter-stage conduit 42 and an outlet 44. The grinder 60 is positioned within the inlet section 41 and includes a rotating cutter 66 positioned within a stationary shredding ring 64. The rotating cutter 66 includes a plurality of cutters 68 (shown in FIG. 8) and has a plurality of slots 61 formed in the outer periphery of the rotating cutter 66. The slots 61 extend from the outer face of the rotating cutter 66 to the inner face of the rotating cutter. The stationary shredding ring 64 has a plurality of channels 46 formed in the inner periphery of the stationary shredding ring 64.

Channels 46 also extend from the outer face of the shredding ring 64 to the inner face of the shredding ring. In addition to the comminuting action of the cutters 68, additional shredding takes place between the slots 61 and the channels 46. Also, the slots 61 and channels 46 act to throttle the inlet flow to the first stage impeller 30.

From the grinder 60, the sewage flows into the first stage volute 55. First stage impeller 30 increases the pressure and discharges into discharge passage 43, where the sewage passes into the inter-stage conduit 42 and enters the second stage volute 56 via second stage inlet 45. Second stage impeller 32 increases the pressure to the final discharge pressure and the sewage passes into the second stage outlet 47 and into pump housing outlet 44.

Figure 9:
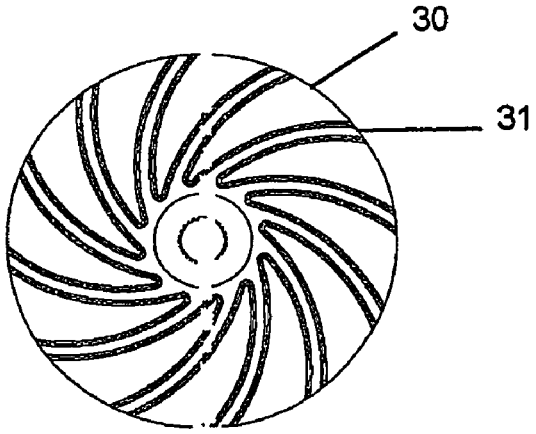
FIG. 9 is a bottom view of the first stage impeller shown in FIGS. 4 and 5.
Figure 10:
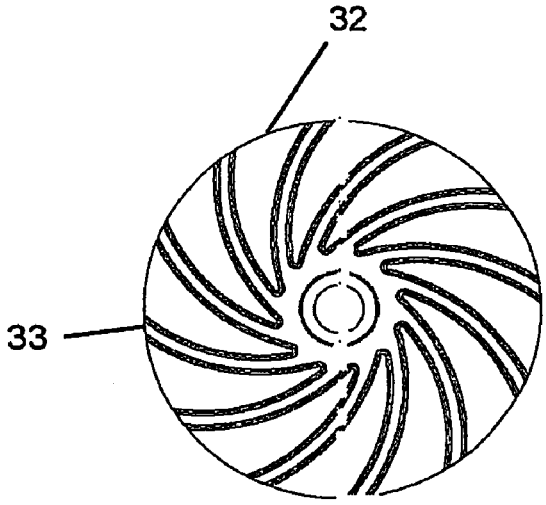
FIG. 10 is a bottom view of the second stage impeller shown in FIGS. 4 and 5.

Preferably, impellers 30, 32 are both vortex impellers. As shown in FIGS. 9 and 10, the impellers are similar. Each impeller has a plurality of pumping vanes 31, 33, respectively, on the pumping face of the impeller. If needed, second stage impeller can include pump out vanes (not numbered) on the rear face of the impeller. In one embodiment, the first stage impeller 30 is ¼ inch larger in diameter than the second stage impeller 32. The first stage volute 55 is also slightly larger than the second stage volute 56. Typically, the pressure increase is divided about 50-50 between the first stage and the second stage.

Referring again to FIG. 7, motor shaft 24 is attached to motor 22. The upper end of motor shaft 24 is enclosed within seal plate 52 that is attached to motor enclosure 20 by a plurality of bolts (not numbered). Within seal plate 52, the shaft 24 is rotatably supported by bearing 48. Below bearing 48 is a stationary seal 51 with a rotating mechanical seal 49 biased into contact with the stationary seal 51 by spring 50. The second stage impeller 32 is threaded onto shaft sleeve 53 and sleeve 53 is then threaded onto shaft 24. First stage impeller 30 is attached to shaft 24 by rotating cutter 66, which is attached to shaft 24 by bolt 58. A suction cover 62 is attached to the lower end of pump housing 40. Rotating cutter 66 and stationary shredding ring 64 fit within a central aperture in suction cover 62.

Impellers 30, 32 and grinder 60 are preferably attached to the same shaft and, more preferably, the impellers 30, 32 are positioned between the motor 22 and the grinder 66.

The discharge conduit 70 is monolithic with motor housing 20. Preferably, motor housing 20 and discharge conduit 70 are a monolithic casting. The discharge conduit 70 is positioned external to the portion of motor housing 20 that encloses motor 22. The discharge 70 connects the pump housing outlet 44 to the inlet 81 of the discharge flange 75. Discharge conduit 70 has an anti-siphon valve 71 integral therewith.

Figure 11:
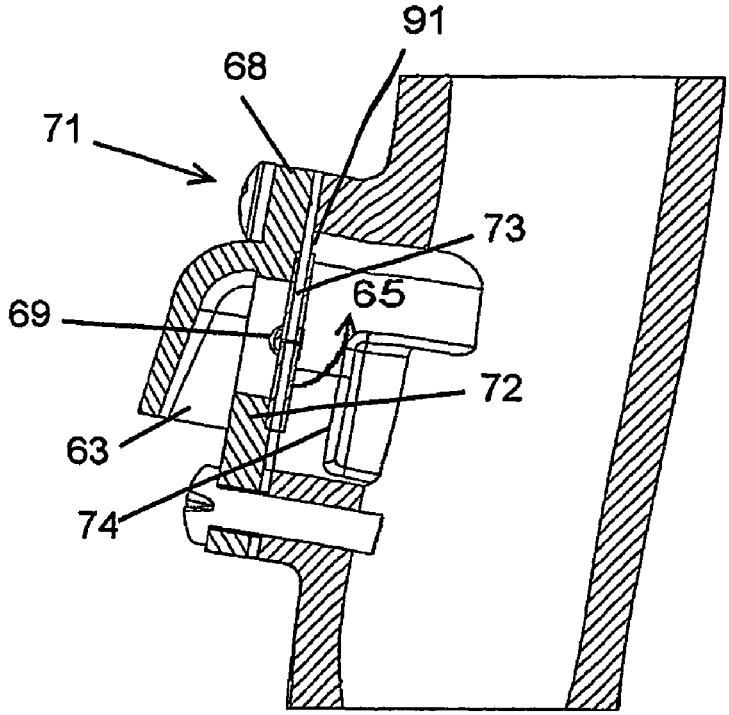
FIG. 11 is a cross-sectional view of the anti-siphon valve shown in FIG. 3, taken on line 11-11.
Figure 12:
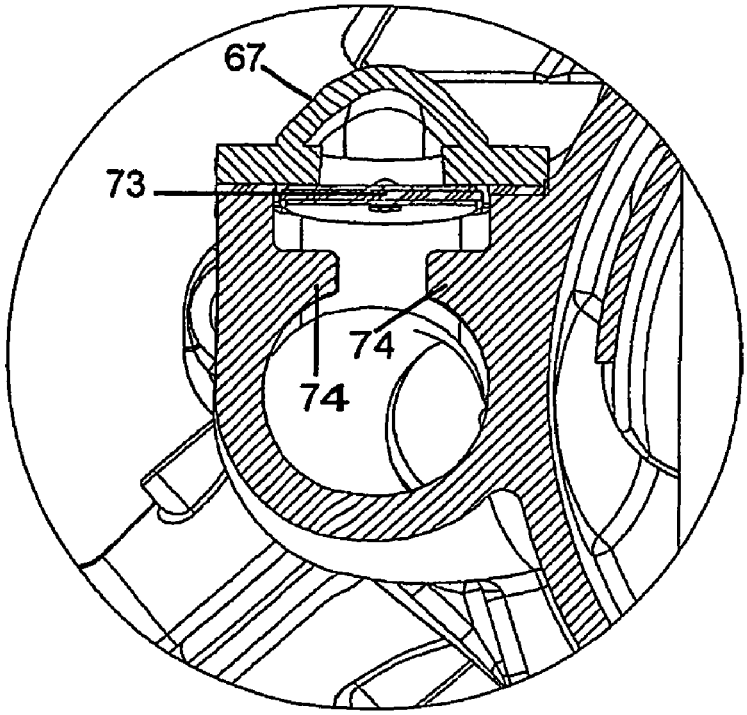
FIG. 12 is a cross-sectional view of the anti-siphon valve shown in FIG. 3, taken on line 12-12.

Details of anti-siphon 71 are shown in FIGS. 11 and 12. Anti-siphon valve 71 is positioned in a side of the discharge conduit 70 and acts to prevent siphoning from basin 100 in the event a break occurs in a downstream section of the sewer pipe. Anti-siphon valve 71 includes a removable cover 67 attached over an opening in the side of discharge conduit 70. The cover 67 forms a downwardly directed outlet 63. The inside of cover 67 forms a valve seat 72 for movable valve 73. Movable valve 73 is formed from an elastomeric material sandwiched between stainless steel washers riveted together. An end portion of movable valve 73 is sandwiched between cover 67 and discharge conduit 70. The section of movable valve 73 adjacent to the stainless steel washers forms a living hinge 91 that permits movable valve 73 to move off the valve seat 72. Movable valve 73 opens in the direction indicated by arrow 65. The center of movable valve includes a bleeder 69 that forms a bleed path to allow both air and liquid to pass through the movable valve. This helps to prevent sticking of the anti-siphon valve 71 and can bleed any air within the pump and discharge conduit upon startup. Formed in discharge conduit 70 are stops 74 that prevent movable valve 73 from inadvertently being pulled into the flowing liquid within discharge conduit 70.

Attached to the top of motor housing 20 is discharge flange 75. Discharge flange 75 has a lift handle 76 formed therein. Within discharge flange 75 is a fluid conduit 80 having an inlet 81 and an outlet 82. The inlet 81 of fluid conduit 80 is connected to the discharge of discharge conduit 70. Integral with discharge flange 75 is a check valve 78. Check valve 78 includes a removable valve seat 79 positioned within the inlet 81 of the fluid conduit 80. A movable valve 77 is attached to the valve seat 79. Check valve movable valve 77 is similar to anti-siphon movable valve 73, but does not include bleeder 69.

Figure 13:
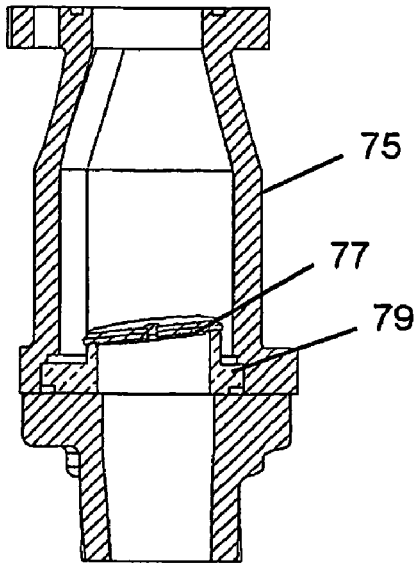
FIG. 13 is a cross-sectional view of a check valve integral with a discharge conduit.

Because check valve 78 is integral with discharge flange 75, installation of sewage grinder pump 10 is simplified by eliminating the need to provide additional piping with a separate check valve. Other configurations of pumps can be accommodated by providing discharge flanges 75 in various configurations (see FIGS. 13 and 16).

Figure 16:
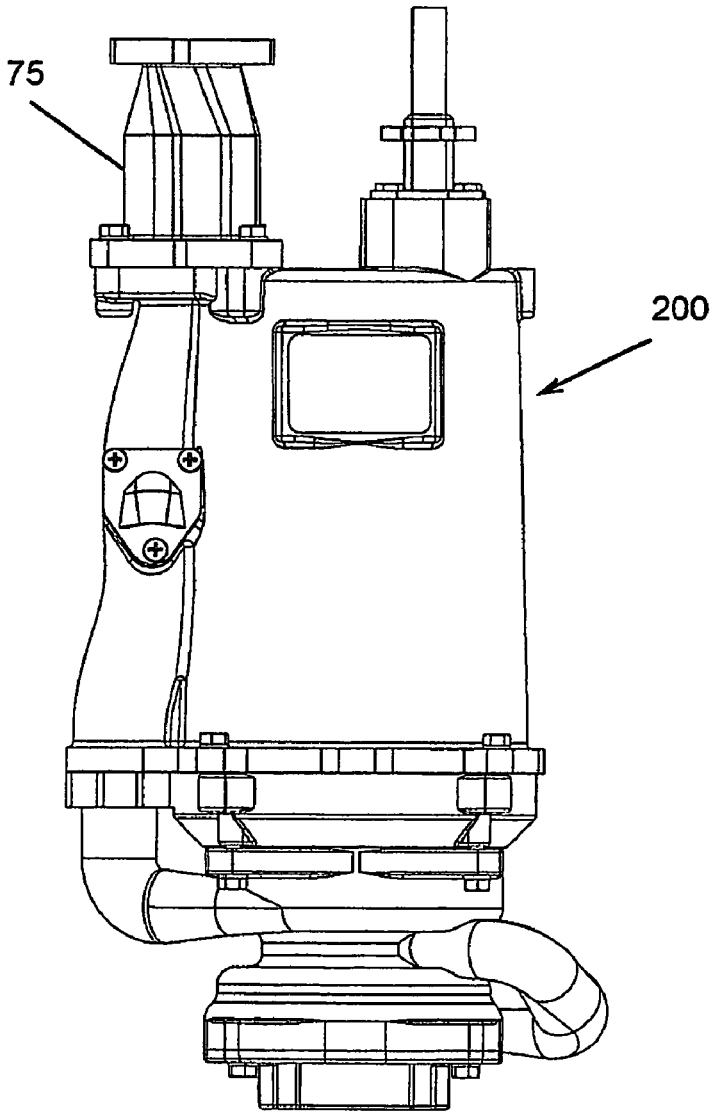
FIG. 16 is a front view of the two-stage sewage grinder pump shown in FIG. 15.

The sewage grinder pump 10 of the present invention can be retro-fitted as a replacement for other style pumps. One such retro-fit pump 200 is shown in FIG. 16. To retro-fit a pump, a sewage grinder pump 200 comprising a pump and motor housing similar to that shown in the FIGURES for sewage grinder pump 10 is supplied. An appropriate discharge flange 75 is selected from a plurality of discharge flanges having various configurations. The discharge flange 75 is attached to pump housing 20. Next the pump 200 is positioned within the basin and the discharge flange 75 is attached to the sewage outlet connection.

Figure 6:
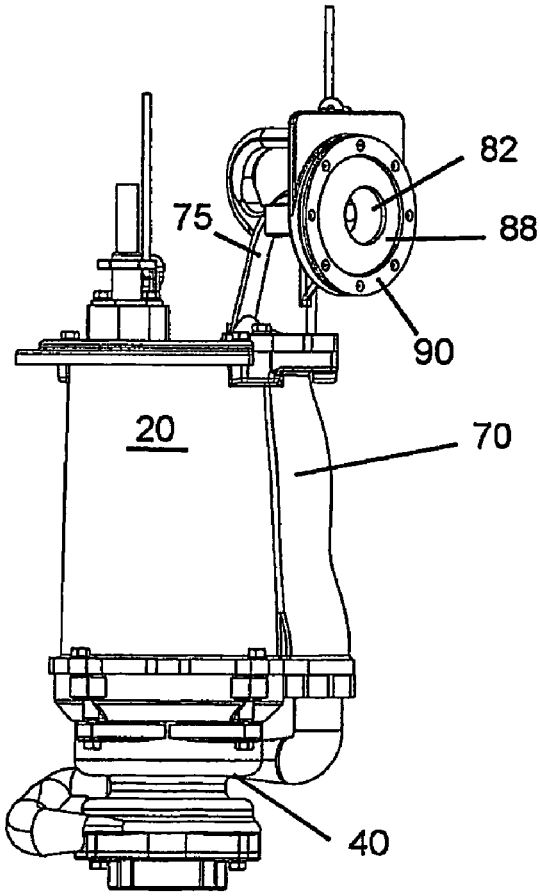
FIG. 6 is a rear view of the sewage grinder pump shown in FIG. 1.
Figure 17:
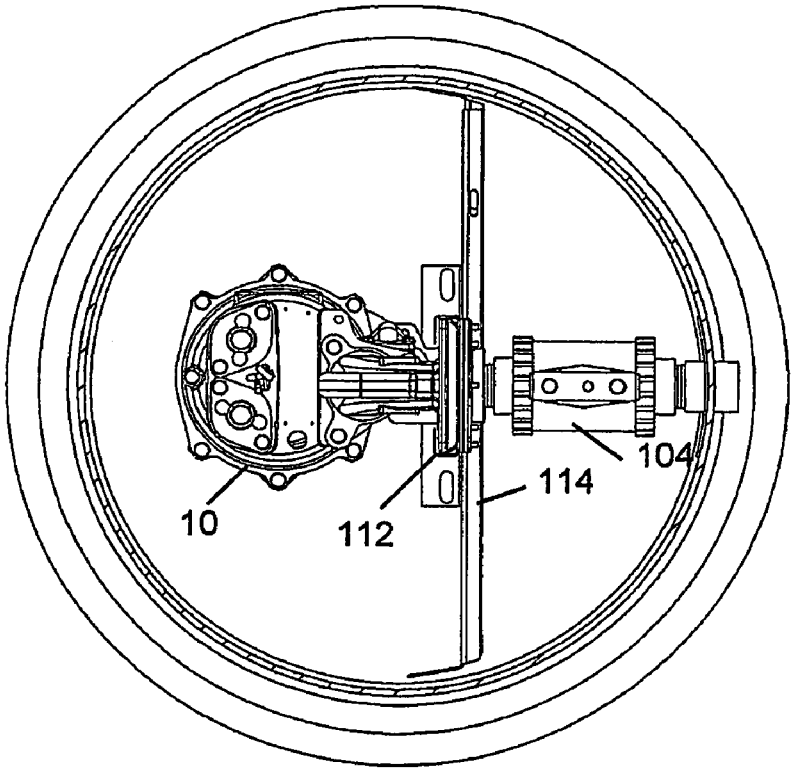
FIG. 17 is a horizontal cross-sectional view of a portion of the sewage grinder pump and basin shown in FIG. 1.
Figure 18:
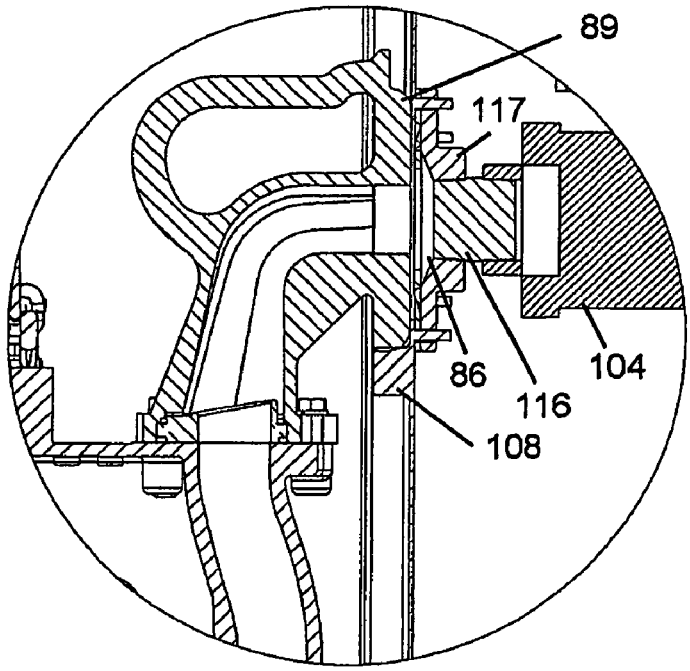
FIG. 18 is a vertical cross-sectional view of the details of the connection of the sewage grinder pump to the sewage discharge.

In one embodiment, discharge flange 75 includes a connector assembly 84 for connecting the discharge of sewage grinder pump 10 to the sewage outlet 110 via a connecting conduit 116 and isolation valve 104. The connector assembly 84 includes a flange 89 that slidably engages a connecting flange 112 attached to support wall 114 (see FIG. 17). In the face of connector assembly 84 (as shown in FIG. 6), an elastomeric seal 86 having a central aperture is attached to flange 89 by a retainer ring 90. The elastomeric seal 86 has a conical shape so that a central portion 88 of the elastomeric seal extends outwardly from flange 89 and engages the surface of connecting conduit mounting assembly 117 to seal the discharge of sewage grinder pump 10 to the connecting conduit 116.

Sewage grinder pump 10 is installed by lowering the pump 10 into the basin 100 using suspension cable 12 and lift handle 76. Flange 89 is slid into the C-shaped basin connecting flange 112 with the elastomeric seal 86 engaging the connecting conduit mounting assembly 117 about the connecting conduit 116 to seal sewage grinder pump 10 to the sewage outlet. Flange 89 sits upon upper support 108 and a flange on the lower end of motor housing 20 sits upon lower support 109 to support sewage grinder pump 10 within basin 100.

The invention claimed is:

1. A sewage grinder pump comprising:

a motor housing;

a pump housing, having an inlet communicated to a first stage volute, a discharge of the first stage volute communicated through an inter-stage conduit to an inlet of a second stage volute and a discharge of the second stage volute communicated to an outlet;

a motor enclosed within the motor housing, the motor having a shaft extending therefrom into the pump housing;

first and second stage centrifugal impellers positioned in the respective first and second stage volutes, each of the centrifugal impellers attached to the motor shaft between the motor and the grinder; and a grinder positioned in the pump housing inlet and attached to the motor shaft, the grinder and the centrifugal impellers having a common axis of rotation inside the pump housing.

2. The sewage grinder pump according to claim 1, wherein the motor shaft extends vertically.

3. The sewage grinder pump according to claim 1, wherein at least one of the centrifugal impellers is a vortex impeller.

4. The sewage grinder pump according to claim 1, wherein the grinder further comprises a means for throttling inlet flow.

5. The sewage grinder pump according to claim 1, further comprising a discharge conduit monolithic with the motor housing and communicated to the pump housing outlet.

6. The sewage grinder pump according to claim 5, wherein the discharge conduit has an anti-siphon valve integral therewith, the anti-siphon valve comprising a valve seat and a movable valve element.

7. The sewage grinder pump according to claim 6, wherein the anti-siphon valve further comprises a means for bleeding fluid.

8. The sewage grinder pump according to claim 6, wherein the anti-siphon valve further comprises a stop, the stop being positioned between the movable valve element and the interior of the discharge conduit.

9. The sewage grinder pump according to claim 6, wherein the movable valve element lies in a plane that is inclined from vertical.

10. The sewage grinder pump according to claim 5, further comprising:

a discharge flange attached to the motor housing, the discharge flange in fluid communication with the discharge conduit; and a check valve integral with the discharge flange.

11. The sewage grinder pump according to claim 10, wherein the discharge flange has a lift handle monolithic therewith.

* * * * *